United States Patent [19]

Smith

[11] Patent Number: 4,502,195

[45] Date of Patent: Mar. 5, 1985

[54] METHOD FOR SEPARATING PARTICULATE MATERIALS FROM FIBROUS MATERIALS DURING START-UP OF TEXTURIZING PROCESS

[75] Inventor: Sanford N. Smith, Spartanburg, S.C.

[73] Assignee: Phillips Petroleum Company, Bartlesville, Okla.

[21] Appl. No.: 427,407

[22] Filed: Sep. 29, 1982

Related U.S. Application Data

[62] Division of Ser. No. 206,514, Nov. 13, 1980, Pat. No. 4,432,867.

[51] Int. Cl.[3] ..... D02G 1/12; D02G 1/16

[52] U.S. Cl. ..... 28/255; 19/205; 28/222; 28/283; 57/305

[58] Field of Search ..... 19/205; 15/306 A; 28/222, 255, 283, 254, 273; 57/305; 209/140, 138, 139 R, 141, 133–135; 226/7

[56] References Cited

U.S. PATENT DOCUMENTS

| | | | |
|---|---|---|---|
| 1,912,910 | 6/1933 | Neuman et al. | 209/141 U X |
| 2,664,010 | 12/1953 | Emerson | 28/273 X |
| 3,103,731 | 9/1963 | Salyer et al. | 28/273 |
| 3,468,002 | 9/1969 | Parker | 28/273 |
| 3,763,526 | 10/1973 | Benson et al. | 28/222 |
| 3,810,285 | 5/1974 | Ferrier et al. | 28/254 |
| 3,937,661 | 2/1976 | Fletcher et al. | 19/205 X |
| 3,956,106 | 5/1976 | Muck et al. | 209/140 X |
| 3,994,052 | 11/1976 | Fernandez | 28/255 |

*Primary Examiner*—Robert R. Mackey

[57] ABSTRACT

In accordance with the present invention, entrained, dense particulate materials are removed from an elongated body of less dense fibrous materials being transported by a moving fluid stream by reducing the velocity of said fluid stream by an amount and for a time sufficient to release a substantial portion of said dense particulate materials, but insufficient to stop the transport of the elongated body of less dense fibrous material by the moving fluid stream.

10 Claims, 5 Drawing Figures

METHOD FOR SEPARATING PARTICULATE MATERIALS FROM FIBROUS MATERIALS DURING START-UP OF TEXTURIZING PROCESS

The present application is a division of prior application Ser. No. 206,514, filed on Nov. 13, 1980, now U.S. Pat. No. 4,432,867 granted Feb. 21, 1984, by Sanford N. Smith for Method and Apparatus for Separating Particulate Materials from Fibrous Materials.

The present invention relates to a method for removing entrained, dense particulate materials from an elongated body of less dense fibrous materials. More specifically, the present invention relates to a method and apparatus for removing entrained balls from yars being transported by a moving fluid stream.

Synthetic fibers are commonly produced by extruding molten polymer through a spinneret. Obviously, the filaments thus produced are smooth and lack the bulk and hand possessed by natural materials such as wool. In order to produce yarns which have properties approximating those of wool or other natural materials, it is common practice to subject the extruded filaments to a texturing process. This can be accomplished by a variety of procedures known in the art, such as stuffer-box crimping, false twist texturing and fluid jet texturing. One particularly effective procedure involves contacting the fibrous materials with a high velocity fluid stream in a turbulent zone and at an elevated temperature. The turbulence imparted to the fiber materials produces crimps which give the fiber a textured bulky appearance. It has more recently been found that improved texturing can be accomplished by passing the yarn from the turbulent zone through a chamber which contains a plurality of discrete particulate elements, such as balls. These balls exert a force on the yarn to produce a wad which extends through the chamber. The yarn wad can then be passed into the inlet end of an elongated tube provided with one or more openings intermediate the ends thereof. A fluid, such as air, is passed through the tube toward the inlet end, with a substantial quantity of the fluid being vented through the openings. The fluid thus exerts a retarding force which tends to prevent breakup of the yarn wad until the yarn has been cooled. Usually the wad is broken up and a single yarn withdrawn adjacent the openings in the tube. The cooled textured yarn is then withdrawn from the outlet end of the tube.

During startup, which of course requires stringing of the yarn through the various apparatus and formation of the wad, it is conventional practice to introduce fluid into the tube downstream of the openings in the tube and in a direction so that the flow of the fluid through the tube will be toward the outlet end and such fluid will act to aspirate the yarn through the tube. This aspirating fluid may be introduced into the tube itself as part of the operation by an appropriate valve system which then reverses the flow toward the inlet end after the operation has become stabilized, or, as is the usual case, the aspirator is a separate flexible tube, usually hand-held by an operator. In any event, during the startup operation and until the wad has formed and the operation has become stabilized, it is conventional practice to pass the aspirated yarn to a waste area or bin. Although the startup time is usually of relatively short duration, the cumulative startups necessitated by restringing of the apparatus due to breaks or other malfunctions become quite significant in commercial operations. Consequently, significant amounts of yarns are passed to waste, which is a saleable item. However, it has been found that a significant number of the balls are entrained in the yarn carried by the fluid stream while the wad is being formed and before the operation has become stabilized. Accordingly, these balls are carried along the flow line, drop out at various points along the flow line, and at times are carried over into the waste. Irrespective of where the balls end up, there is obviously a significant loss of the balls, which is a significant cost factor, but, in addition, natural separation of the balls from the waste yarn, dropping of the balls on the floors, and the carryover of the balls into the waste, which is sold for various purposes, all constitute safety hazards.

It is therefore an object of the present invention to provide an improved method and apparatus for separating entrained, dense particulate materials from an elongated body of less dense fibrous materials. Another and further object of the present invention is to provide an improved method for removing entrained, dense particulate materials from an elongated body of less dense fibrous materials and retrieving the particulate materials. A further object of the present invention is to provide a method and apparatus for removing entrained dense particulate materials from a synthetic yarn being transported by a moving fluid stream. Another object of the present invention is to provide an improved method and apparatus for removing small balls from a synthetic fibrous material being transported by a moving fluid stream. A still further object of the present invention is to provide an improved method and apparatus for removing balls from a synthetic yarn being transported by a fluid stream, which balls have become entrained in the yarn during the texturing of said yarn. These and other objects and advantages of the present invention will be apparent from the following description when read in conjunction with the drawings.

SUMMARY OF THE INVENTION

In accordance with the present invention, entrained, dense particulate materials are removed from an elongated body of less dense fibrous materials being transported by a moving fluid stream by reducing the velocity of said fluid stream by an amount and for a time sufficient to release a substantial portion of said dense particulate materials, but insufficient to stop the transport of the elongated body of less dense fibrous material by the moving fluid stream.

DESCRIPTION OF THE PREFERRED EMBODIMENTS

Figure 1:
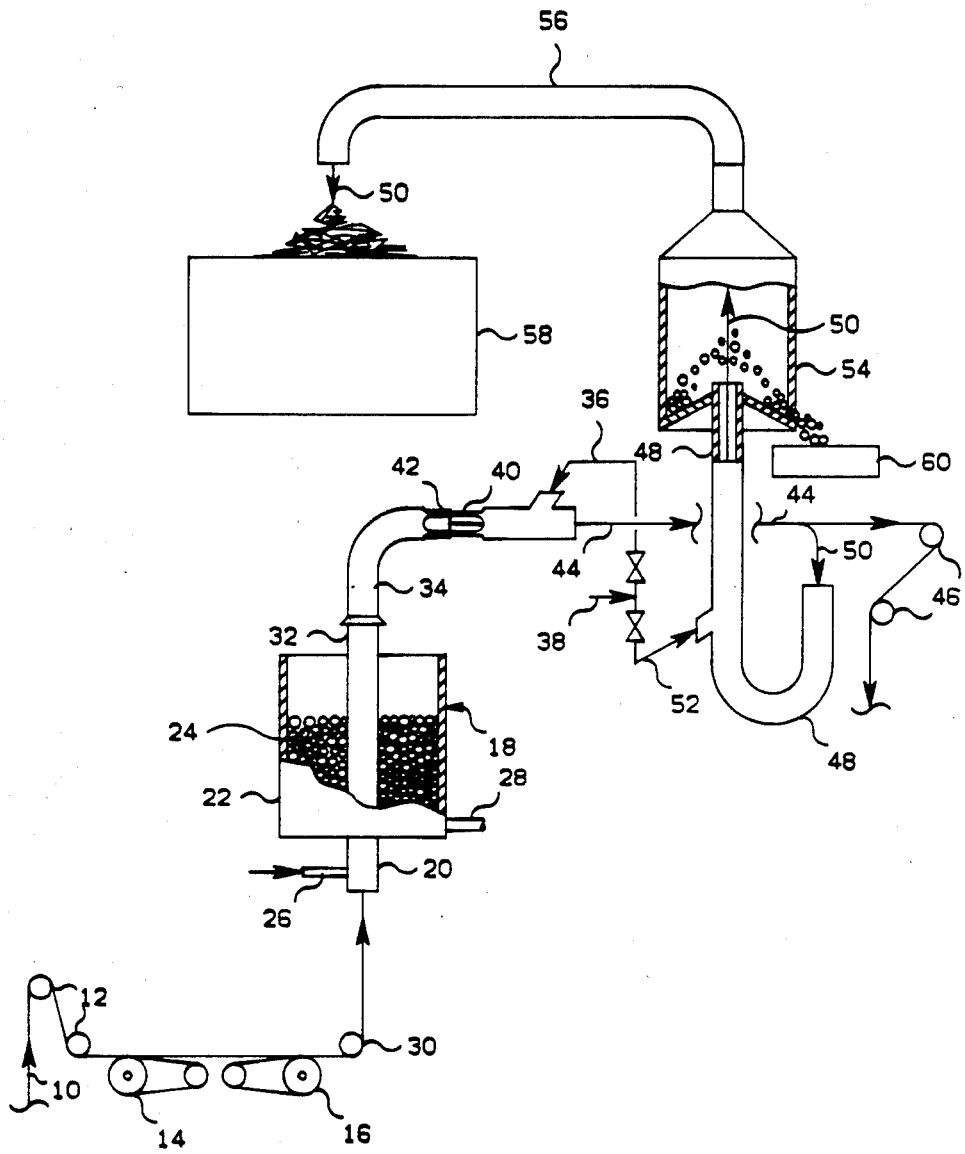
FIG. 1 is a simplified flow diagram, partially in section, of a portion of a yarn processing line, including one embodiment of the present invention.

With reference to FIG. 1 of the drawings, it is to be understood that the drawing does not necessarily depict the actual relative sizes, shapes and spatial relationships of the various pieces of equipment illustrated but that the figure is for illustrative purposes only and various items of equipment have been enlarged and/or distorted to some extent for such illustrative purposes.

As previously indicated, synthetic fibers are generally produced by extruding molten polymer through a spinneret or spinnerets in order to produce individual filaments. Upon solidification of the filaments, the filaments are generally collected into groups to form yarns which may be more readily handled in subsequent processing. After collection of a plurality of filaments to form a tow or yarn, the yarn is generally wound up to form a package. In a commercial operation, a plurality of such yarn packages can be produced in a single production line or a single package produced from a plurality of spinnerets. In any event, the yarns, thus produced and wound up to form individual packages of yarn, are generally referred to as "as spun" yarns to the extent that the yarns have not been processed in any manner to alter the properties thereof except to the extent that a certain degree of drawing of the yarn has taken place during the spinning operation itself. It should be recognized, of course, that numerous operations designed to alter the properties of the fibrous materials thus produced can be carried out during the spinning operation, i.e., before windup. However, for purposes of the present description, it is assumed that the fibrous materials utilized are undrawn yarns in their "as spun" condition. When synthetic fibers are to be further treated by texturing, as in the present application, it is common practice to combine a plurality of yarns from a plurality of packages of undrawn yarns to produce a yarn of the desired total denier. Such a yarn is illustrated by the line 10 of FIG. 1. Yarn 10 is then passed over a tensioning gate or tensioning pins 12 to provide better control of the yarn. The yarn is then fed to a heated feed roll 14 and onto a heated draw roll 16. Either or both of these rolles are suitable for use as a heating zone or a heating means. The draw ratio should be the highest ratio consistent with good drawing performance. The yarn is then fed to a suitable crimping means or texturing means denoted by reference numeral 18. In the embodiment illustrated, the crimping means 18 is a fluid jet crimper, as is known in the art. However, other crimping means such as a stuffer-box crimper could be used. The only limitation imposed on the crimping means 18 is that it be of the type which produces a yarn plug. The crimping means 18 contains a fluid jet portion 20 and a chamber 22 containing a plurality a stacked members 24, such as small balls. A suitable heating fluid such as steam enters the fluid jet portion 20 of crimper 18 by way of line 26. The steam heats the yarn 10, assists in crimping and exits the crimper by way of line 28 and through the stacked members or balls 24. While it is not necessary, an adjustable angle idler 30 may be used to insert a controllable amount of false twist into the yarn prior to crimping. This is useful in controlling heat losses from the yarn and, hence, the yarn temperature entering the crimping means 18. The yarn plug 32 formed in the crimping means 18 is passed through a tube 34 in which the yarn plug 32 is broken up and cooled by countercurrent air entering the tube through line 36 or other suitable cooling fluid supplied through line 38. The major portion of the air entering through line 36 exits through openings 40 in tube 34. In any event, the back pressure of the air through line 36 is sufficient to maintain the plug 32 in the tube 34 for a time sufficient to completely cool the yarn and thereby set the crimp by the time the yarn plug reaches the openings 40. In actual practice, the process is generally controlled in a manner such that the end 42 of plug 32 is maintained adjacent the openings 40 in the tube 34. Tube 34 may be straight or curved, as shown, and the openings 40 may be positioned in the vertical or horizontal portion of tube 34. After the plug 32 is broken up, the crimped yarn 44 is withdrawn, passed over appropriate tensioning pins or tensioning gate 46, and thereafter further processed. Such further processing can, for example, include entangling the yarn, cutting it into staple or simply winding the yarn up to form a package. In general, a large number of relatively small balls 24 are present in chamber 22. These balls can be formed of metal, glass or any other material which is inert to the yarn and temperatures encountered. The balls are advantageously spherical in nature but this is not essential to the operation. In addition, it is generally common practice to use larger balls having a diameter of about $\frac{1}{4}$ inch in admixture with smaller balls having a diameter of about $\frac{1}{8}$ inch. In such instance, approximately 75 percent of the total number of balls are the larger balls. Also in general practice, the balls are of metal and are generally ball bearings which are not suitable for use for their original purposes. However, they perform quite adequately when utilized in accordance with the present invention.

The details of the texturing and plug-forming apparatus can be found, for example, in U.S. Pat. No. 3,693,222 and 3,994,052.

Similarly the full process line and the control of the position of the end 42 of the plug 32 can be found in U.S. Pat. Nos. 4,012,816 and 4,135,511.

Obviously, during startup of the texturing operation, plug 32 will not be completely formed and the desired degree of texturing of the yarn will not have occurred. Therefore, the yarn produced during such startup time is not suitable for use as a finished product. Consequently, during startup and until the system has become stabilized and product quality yarn is being produced, the yarn is generally withdrawn some time prior to windup or the production of the final product and is passed to a waste area or waste receptable. This may be readily accomplished by the utilization of an aspirator tube 48 which draws waste yarn 50 from the normal path or the yarn by means of air supplied concurrently with the flow of the yarn through aspirator tube 48, which air is supplied through line 52. The aspirator tube 48 may be a part of tube 34 or preferably is a separate tube. During such startup operations and before the system has become stabilized and produces product quality yarn, and particularly while the plug 32 is being formed, it has been found that there is a tendency for a significant amount of the balls 24 to become entrained in the yarn. While the duration of the startup time is not great and thus the number of balls picked up at any given time will not be great, it is to be recognized that in a commercial operation many lines such as that illustrated in FIG. 1 are involved and because of yarn breaks and other system upsets, each line must be rethreaded and restarted any number of times. Consequently, over a period of time, in a commercial operation, the volume of balls entrained in the waste yarn 50 during startup is quite significant and their loss is a significant economic factor. In addition, the balls will, to some extent, drop out of the waste yarn 50 of their own accord, become scattered over the floors, and will sometimes be forcefully ejected and, in any event, thus become a safety hazard in an operation of this nature. Accordingly, in accordance with the present invention, it has been found that the waste yarn 50 may be substantially freed of entrained balls by reducing the velocity of the air stream 52 carrying the waste yarn 50. As illustrated in FIG. 1, this is accomplished by passing the waste yarn 50 from the end of the tube 48 through a zone or chamber 54 of expanded diameter or cross section. This sudden expansion reduces the velocity of the air carrying the waste yarn 50 and in doing so, also reduces the pressure and permits the balls to drop out of the waste yarn 50 of their own accord, of course, with the aid of gravity. The waste yarn 50 then passes through a reduced diameter tube 56 to a waste yarn storage bin or area 58. The balls which drop out of the waste yarn 50 in separator chamber 54 can be continuously or periodically collected in a container 60 and reused in the texturing apparatus.

Figure 2:
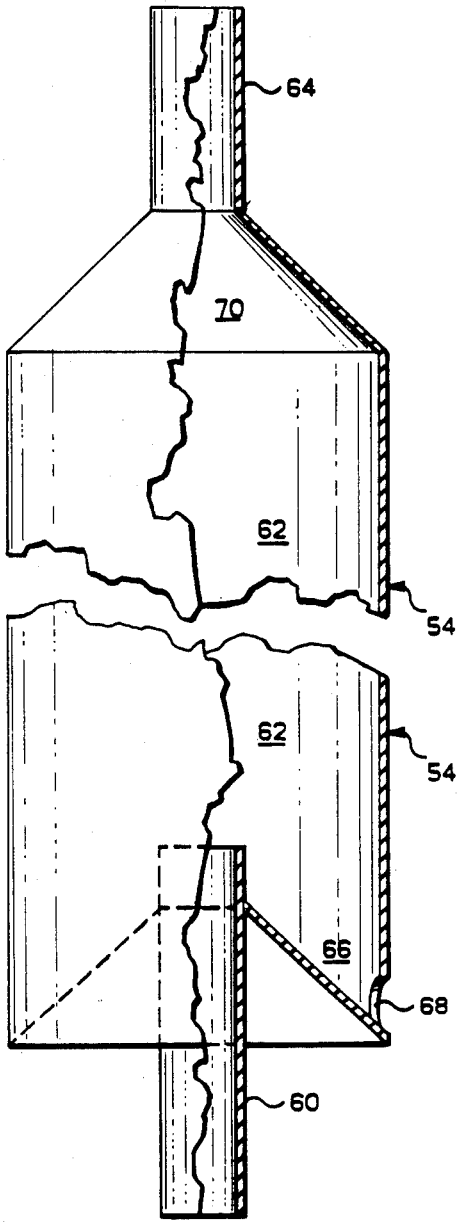
FIG. 2 is an elevational view, partially in section, showing the embodiment of FIG. 1 of the present invention in greater detail.

FIG. 2 of the drawings illustrates in greater detail, the structure of a separator 54, such as that illustrated in FIG. 1. Specifically, separator 54 includes a tubular entry means 60, an intermediate expanded diameter portion or chamber means 62 and a tubular exit means 64. As shown in FIG. 2, the bottom of separator 54 between entry tube means 60 and the outer shell of the separator is frustoconical to form a lower collecting section 66. Section 66 of the separator is thus designed to collect balls separated from the yarn as it passes through the intermediate or midsection of separator 54. Collecting section 66 is provided with an opening 68 for removal of collected balls. Opening 68 may be open so as to remove balls continuously or it may be provided with a plug or door or other type of closure. Separator 54 also has an upper frustoconical section 70 formed by decreasing the diameter of midsection 62 to the diameter of exit means 64. This frustoconical section serves several purposes. First, balls which have been released from the moving yarn but which have a tendency to be carried downstream by the air in the separator 54 will strike the frustoconical sidewalls and drop to the bottom collection section 66. Secondly, the gradual tapering of section 70 aids in the passage of the yarn into and through tubular exit means 64.

By way of illustration, midsection 62 of separator 54 will generally vary in diameter between about 4 and 8 inches and will have a length anywhere between about 3 and 5 feet. In a specific commercially successful device, midsection 62 was made of 6 inch Schedule 10 aluminum pipe approximately 4 foot in length. Tubular entry means 60 was made of 1½ inch O.D. aluminum tubing approximately 6 inches long with one inch extending above the frustoconical section. The frustoconical section was made of 14 gauge aluminum, welded between the entry tube and the body of separator 54. The discharge opening 68 was a hole approximately one inch in diameter. It should be recognized that the frustoconical bottom of the separator can be at any appropriate angle, the only requirement being that the separated balls will drop into and be collected in the bottom of the separator without interfering with the yarn as it is transported out of the upper end of entry tube 60. As the air transporting the yarn through tubular entry means 60 abruptly expands into the central or midportion 62 of the separator 54, a certain amount of reverse circulation of the air rearwardly into collection section 66 and "mixing" of the air takes place. Accordingly, this reverse circulation and mixing causes entrained balls to be released from the yarn and most of the balls will be separated in the first portion of midsection 62 adjacent the outlet opening of entry tube 60. However, it should be recognized that the reduction in velocity of the air stream transporting the yarn through separator 54, which is caused by such expansion, reverse circulation and mixing is insufficient to significantly affect the ability of the air stream to transport the yarn through the separator 54 and into and through the outlet tube 64. Even though the air expands and reverse circulation and mixing occur in midportion 62 of the separator, the main stream of the air will travel through the separator as a concentrated, axial core and the peripheral air around this core is still moving in a generally upward direction and again becomes concentrated through the outlet tube 64. The reduction in the velocity of the air stream in passing from the entry tube 60 to the outlet tube 64 will depend upon the relative cross-sectional dimensions of tubes 60 and 64 as compared with midsection 62, upon the actual weight or density of the yarn being carried by the air stream and upon the pressure of the air stream itself. For example, where the entry tube 60 and the exit tube 64 were 1½ inches in diameter and midsection 62 of the separator 54 was 6 inches in diameter, the air stream utilized to transport the yarn through the separator and into a waste storage bin was supplied through a ⅜-inch pipe at a pressure of 90 psi. In order to "reconcentrate" the air and facilitate the passage of the air and yarn through exit tube 64, the frustoconical section 70 should be at an acute angle with respect to a diametric plane of the separator. More specifically, this angle may vary from the diametric plane anywhere up to about 45°. It has been found that, where the angle is zero and the exit end is essentially flat, the exit of the yarn through the exit tube 64 is interfered with and that, where the angle is greater than about 45°, difficulties are also experienced in feeding the yarn through the exit tube 64.

Figure 3:
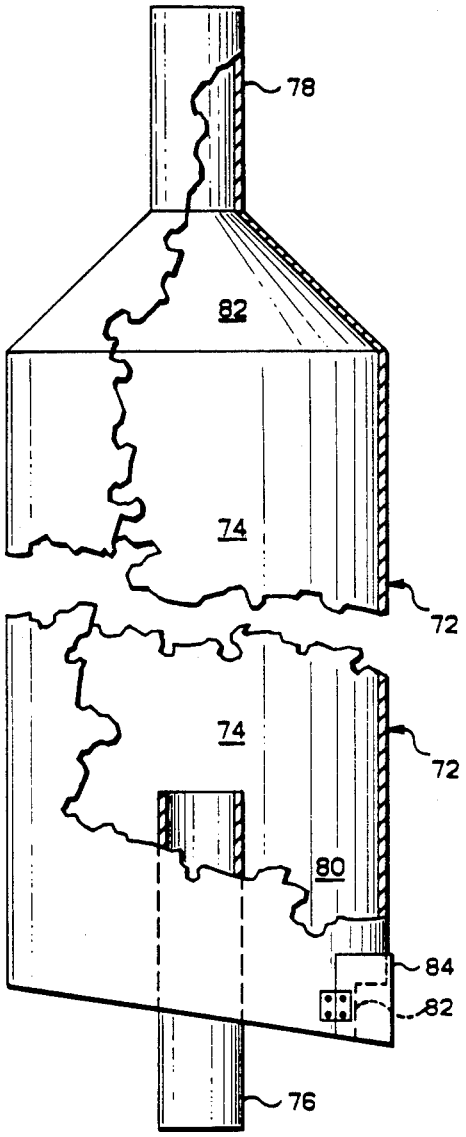
FIG. 3 is an elevational view, partially in section, of another embodiment of the present invention.

FIG. 3 of the drawings shows another embodiment of the separator of the present invention. In accordance with FIG. 3, the separator, designated generally by the numeral 72, comprises an expanded midsection or central portion 74, a tubular entry means 76, a tubular exit means 78, a lower collecting section 80, for collecting separated balls, and an upper frustoconical section 82 connecting the midsection 74 to the exit tube 78. As illustrated in FIG. 3, this embodiment of the separator has a sloping bottom disposed at an angle of about 10° from the horizontal and sloping downwardly toward an opening 82 for the removal of collected, separated balls. The sloping bottom may, of course, vary in the degree of slope and may be frustoconical as shown in FIG. 2 in addition to sloping as shown in FIG. 3, the only requirement being that collecting section 80 slopes toward the opening 82 to facilitate removal of collected balls. As in FIG. 2, the entry tube 76 extends through the bottom of separator 72—in this case, approximatey 4 inches—to provide the collection section 80 thereabout. The ball removal opening 82 may be provided with a hinged door 84 for periodically removing collected balls from separator 72. The relative dimensions of this embodiment of the invention are similar to those of the embodiment of FIG. 2, for example, the entry tube 76 and the exit tube 78 are each 1½-inch O.D. aluminum tubing with the entry tube 76 being approximately 6 inches long and the exit tube approximately 3 inches long. The midsection is a 6 inch Schedule 10 aluminum pipe and the frustoconical section 82 has an angle of about 45° from a diametric plane.

Figure 4:
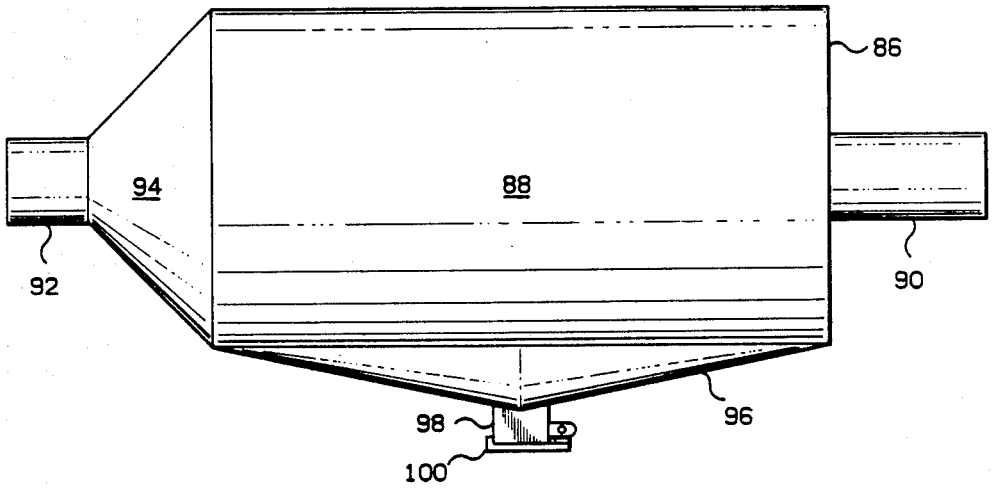
FIG. 4 is a side view of yet another embodiment of the present invention.
Figure 5:
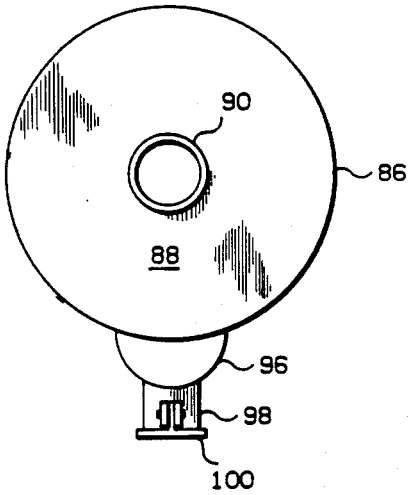
FIG. 5 is a right hand end view of the embodiment of FIG. 4.

While the embodiments of FIGS. 2 and 3 show separators which would be utilized in a vertically oriented manner, FIGS. 4 and 5 of the drawings illustrate another embodiment of the separator which can be utilized in a generally horizontal mode. While the vertically disposed embodiments shown in FIGS. 2 and 3 can advantageously be manufactured from readily available components and are relatively inexpensive to construct, certain advantages exist in the use of a horizontally disposed separator as shown in FIGS. 4 and 5. The separator of FIGS. 4 and 5 entry tube means 90 and an exit tube means 92, all of generally the same configuration and size as the embodiments of FIGS. 2 and 3. It should be noted, however, that in this embodiment, the entry tube 90 does not extend into the midsection or expanded portion 88 of the separator 86. This is true since it is not necessary in this embodiment to provide for a separating section adjacent the exit end of entry tube 90. This has a number of advantages. As the air transports the yarn through entry tube 90 an abrupt expansion of the air carrying the yarn into expanded section 88 of the separator 86 still occurs with consequent reverse circulation of the carrier air into the corners of the midsection 88 and consequent mixing and separation of the balls from the yarn. However, since the collection section rearwardly or upstream of the end of entry tube 90 is eliminated the pressure and velocity of the air carrying the yarn is not reduced to as great an extent and thus the overall pressure of the air necessary to carry the yarn through the separator 86 will be reduced and/or the dimensions of the separator 86 may be changed while maintaining the carrier air pressure the same. The utilization of separator 86 in a horizontal position also aids in the separation of the balls from the moving yarn, to the extent that the forces of gravity are acting all the way along the length of the yarn as it is passing through the central chamber 88. The bottom of separator 86 may take a number of different configurations, the only requirement being that it slope to a single point or area for collection and removal of the separated balls. For ease of manufacture, the embodiment of FIGS. 4 and 5 show a slot cut in the bottom of section 88 of separator 86 and two pieces of tubing split along their length at an angle and welded over the slot to form a collecting channel 96. The balls may be removed from collecting channel 96 through a collection tube 98 or simply through a hole in channel 96. If a hole is provided, the hole may be simply plugged or left open or it may be provided with a hinged door or the like. Similarly, the ball removal tube 98 may be provided with a hinged cover 100 as shown in the figures or simply a press fit cap or plug.

While specific dimensions and configurations have been shown in the drawings hereof and described in the specification, it is to be understood that references to materials of construction, dimensions and various elements and the general arrangements of parts can be varied without departing from the present invention and that one skilled in the art can, with little experimentation, determine appropriate sizes and materials of construction and operating conditions and procedures necessary to practice to present inventiion.

I claim:

1. In a process for texturizing a multifilament strand of fibrous material, wherein; the strand is contacted with a high velocity fluid jet in a turbulent zone and at an elevated temperature, the strand is then passed through a body of dense, particulate material to produce an elongated wad, the wad is passed through a first elongated, confined zone while simultaneously passing a first fluid stream toward the inlet end of the first confined zone to retard break-up of the wad and cool the same and the wad is then broken up and the strand withdrawn from the first confined zone to a product collection zone; a method of starting up the process, during which start-up a portion of the particulate material becomes entrained in the wad and the strand, comprising:

(a) diverting the strand from its normal path from the first confined zone to the product collection zone by transporting said strand upwardly through a confined inlet zone by a second fluid stream;

(b) continuing transporting said strand upwardly through a substantially enlarged, confined, disengaging zone while simultaneously reducing the velocity of said second fluid stream by an amount and for a time sufficient to release a substantial portion of said particulate material but insufficient to stop the transport of said strand by said second fluid stream and in a manner to maintain said strand unencumbered for a substantial distance on all sides and maintain the thus released particulate material out of contact with said strand;

(c) collecting the thus released particulate material;

(d) transporting said strand upwardly through a confined outlet zone spaced from said confined inlet zone by the distance of said disengaging zone; and (e) passing said strand to a waste collection zone;

(f) said start-up being continued for a time sufficient to stabilize the texturizing process by the complete formation of the wad and the obtension of the desired degree of texturizing of the strand.

2. A method in accordance with claim 1 wherein the dense particulate material is a plurality of small balls.

3. A method in accordance with claim 2 wherein the balls are approximately $\frac{1}{8}$ to $\frac{1}{4}$ inch in diameter.

4. A method in accordance with claim 1 wherein the second fluid stream is air aspirated through the confined inlet zone.

5. A method in accordance with claim 1 wherein particulate material is collected in a zone surrounding the inlet zone and below the disengaging zone.

6. A method in accordance with claim 5 wherein the thus collected particulate material is at all times maintained out of contact with the strand in the inlet zone and the disengaging zone.

7. A method in accordance with claim 1 wherein the inlet zone and the outlet zone are of essentially the same cross-sectional dimension.

8. A method in accordance with claim 7 wherein the disengaging zone is substantially larger in cross-sectional dimension than the inlet zone and the outlet zone.

9. A method in accordance with claim 1 wherein the cross-sectional dimension of the inlet zone abruptly changes to the cross-sectional dimension of the disengaging zone.

10. A method in accordance with claim 1, or 3 wherein the strand is a strand of synthetic yarn.

* * * * *